United States Patent [19]

Morin

[11] Patent Number: 4,706,885

[45] Date of Patent: Nov. 17, 1987

[54] LIQUID DISTRIBUTION SYSTEM

[76] Inventor: Rolland L. Morin, 5550 Carleton Rockwood Rd., South Rockwood, Mich. 48179

[21] Appl. No.: 892,737

[22] Filed: Jul. 30, 1986

Related U.S. Application Data

[63] Continuation of Ser. No. 638,125, Aug. 6, 1984, abandoned.

[51] Int. Cl.[4] ..... B05B 15/00

[52] U.S. Cl. ..... 239/76; 239/124; 239/551; 239/565

[58] Field of Search ..... 239/126, 127, 548, 551, 239/562, 124, 450, 207, 76, 565; 137/861, 883

[56] References Cited

U.S. PATENT DOCUMENTS

| | | | |
|---|---|---|---|
| 2,244,686 | 6/1941 | Garrison et al. | 239/76 |
| 2,266,354 | 12/1941 | Christenson | 239/126 X |
| 2,723,680 | 11/1955 | Danel . | |
| 2,810,607 | 10/1957 | Hruby | 239/551 X |
| 3,023,968 | 3/1962 | Mitchell | 239/126 X |
| 3,103,942 | 9/1963 | Sharp . | |
| 3,376,897 | 4/1968 | Dolder et al. . | |
| 3,407,842 | 10/1968 | Zahuranec . | |
| 3,496,261 | 2/1970 | Parr . | |
| 3,522,910 | 8/1970 | Pfeiffer et al. . | |
| 3,794,056 | 2/1974 | Warren . | |

OTHER PUBLICATIONS

Crane Co., "Flow of Fluids Through Valves, Fittings, and Pipe", 1979, pp. 1-6, 1-7 and 3-2.

*Primary Examiner*—Andres Kashnikow
*Assistant Examiner*—Daniel R. Edelbrock
*Attorney, Agent, or Firm*—Gifford, Groh, VanOphem, Sheridan, Sprinkle and Dolgorukov

[57] ABSTRACT

The present invention provides a paint distribution system which is particularly suited for a multiple station paint spray operation. The system includes a reservoir of paint and a piping system having an inlet and outlet both of which are open to the reservoir. A pump pumps the paint from the inlet and towards the outlet while a plurality of liquid taps, for example paint spray guns, are provided along the piping system at spaced intervals. The piping system further includes a plurality of conduit segments wherein one conduit extends between each paint tap. Furthermore, the length and internal diameter of each conduit segment is dimensioned to produce a predetermined of paint flow through each tap when the tap is closed.

2 Claims, 1 Drawing Figure

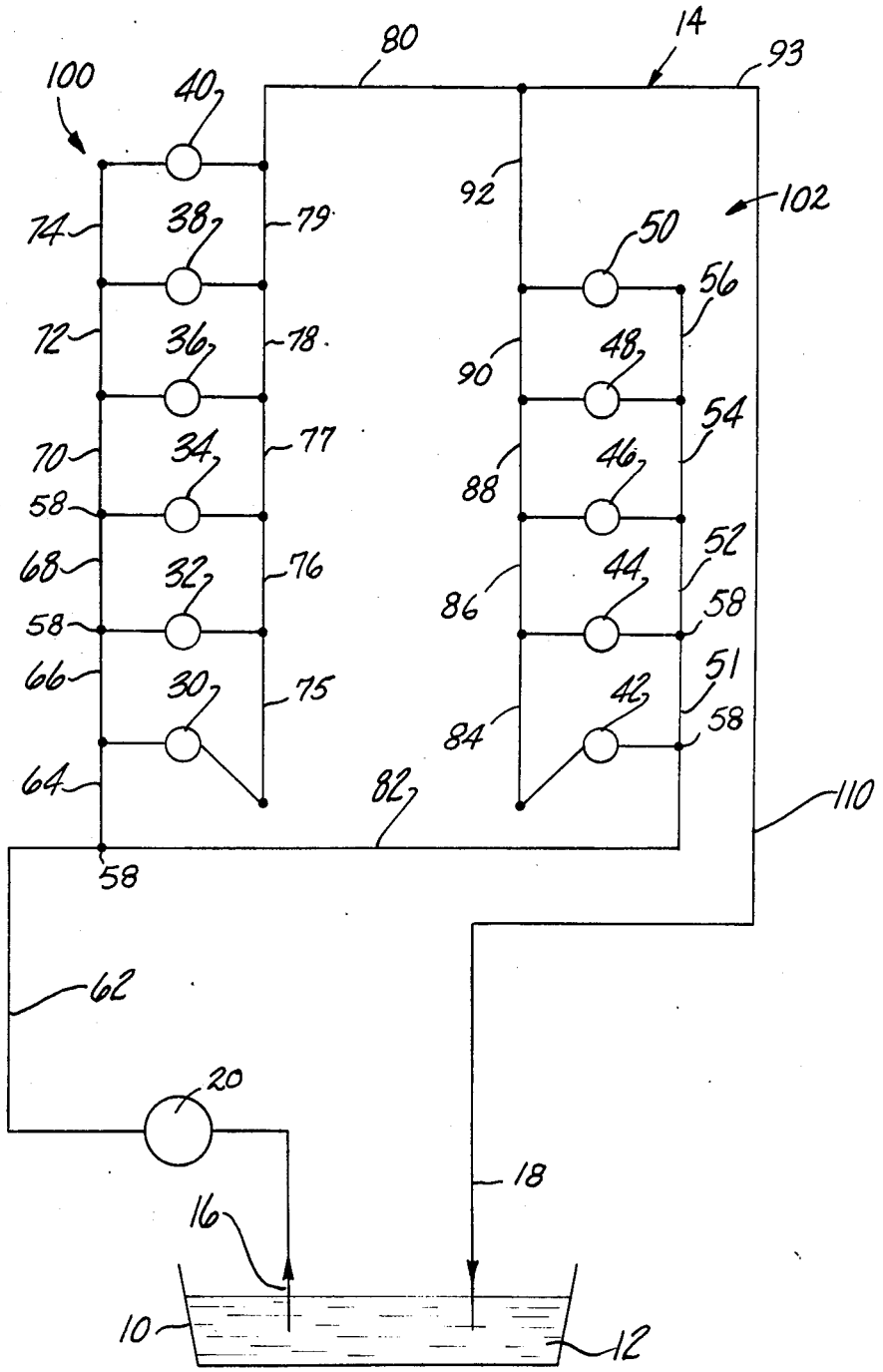
100
40
38
36
34
32
30
74
72
70
58
68
58
66
64
58
79
78
77
76
75
80
92
90
88
86
84
82
14
93
102
50
56
48
54
46
52
44
58
51
42
58
110
62
20
18
16
10
12

LIQUID DISTRIBUTION SYSTEM

This is a continuation of co-pending application Ser. No. 638,125 filed on 8/6/84, now abandoned.

BACKGROUND OF THE INVENTION

I. Field of the Invention

The present invention relates generally to liquid distribution systems and, more particularly, to a paint distribution system.

II. Description of the Prior Art

There are a number of previously known paint distribution systems for multiple station paint spray operations. Typically, the paint is maintained within a reservoir or drum and is connected to a plurality of spaced paint spray guns by a piping system. In order to prevent coagulation of the paint within the piping system, the paint is continuously circulated from the paint reservoir, to the paint spray guns and then back to the reservoir. In the event that the paint spray gun is actuated, it forms a liquid tap through which a portion of the paint within the piping system is discharged through the paint spray gun. Conversely, if all the guns are unactuated so that the liquid taps are all closed, the paint simply circulates through the piping system and is returned to the reservoir.

In order to maintain the velocity of the paint through the piping system and thus prevent coagulation of the paint, these previously known paint distribution systems typically employ a plurality of pressure regulators at spaced intervals throughout the piping system. One pressure regulator is conventionally associated with each color at each paint spray station and is adjusted to maintain a predetermined velocity in the circulating system. This pressure setting assures a minimum velocity of the paint within the piping system.

A primary disadvantage of these previously known paint distribution systems with pressure regulators is that the regulators are not only inaccurate but are also expensive to install and maintain. Furthermore, the pressure regulators must be periodically adjusted thus increasing the maintenance cost of the paint spray system.

SUMMARY OF THE PRESENT INVENTION

The present invention provides a paint distribution system which overcomes all of the above-mentioned disadvantages of the previously known systems.

In brief, the system of the present invention comprises a reservoir of paint and a piping system having its inlet and outlet open to the reservoir. A pump pumps the paint from the reservoir under pressure from the inlet and towards the outlet of the piping system.

A plurality of selectively operable liquid taps are provided at spaced intervals along the piping system. These liquid taps can, for example, comprise paint spray guns which, upon actuation, discharge a portion of the paint within the piping system through the spray gun.

The piping system further comprises a plurality of conduit segments wherein one conduit segment extends between each liquid tap. Furthermore, both the length and internal diameter of each conduit segment is dimensioned to produce a predetermined rate of liquid flow through the tap when the tap is opened thus completely eliminating the previously known need for pressure regulators.

BRIEF DESCRIPTION OF THE DRAWING

A better understanding of the present invention will be had upon reference to the drawing which is a diagrammatic view illustrating a preferred embodiment of the present invention.

DETAILED DESCRIPTION OF A PREFERRED EMBODIMENT OF THE INVENTION

With reference to the drawing, a preferred embodiment of the liquid or paint distribution system of the present invention is thereshown and comprises a reservoir 10 in which the liquid or paint 12 is contained. A reservoir 10 having an outlet 16 and an inlet 18 is fluidly connected to the piping system 14 while a pump 20 pumps the paint 12 from the reservoir 10 from the reservoir outlet 16 and towards the reservoir inlet 18.

A plurality of liquid taps 30–50 are provided at spaced intervals along the piping system 14. These liquid taps 30–50 are preferably paint spray stations and, therefore, are selectively actuatable between an open and a closed position. When open, a portion of the paint flowing through the piping system 14 is discharged by the paint spray gun. Conversely, with the taps 30–50 in their closed position, the paint within the piping system 14 flows past each tap 30–50 and to a return pipe 110 which returns the paint through the reservoir inlet 18 to the reservoir 10.

As shown in the drawing, the piping system 14 can also include one or more flow splitters 58. These flow splitters 58 divide the paint flow through the piping system in a fashion which will be subsequently described in greater detail.

The piping system 14 comprises a plurality of conduit sections on the supply and return piping. One conduit section 62 fluidly connects the pump 20 to the flow divider 58 while further conduit section 64 fluidly connects the divider 58 with the tap 30. Similarly, a further fluid conduit 66 fluidly connects the tap 30 to the tap 32 while conduit sections 68–74 respectively and successively connect the taps 34 through taps 40. Similarly, a further fluid conduit 82 connects conduit sections 51–56 to taps 42–50.

Similarly, the conduit sections which form the return line increase in diameter from the tap 30 and to the tap 40 and also from the tap 42 and to the tap 50.

Each conduit section 51–92 is dimensioned to produce a predetermined rate of liquid flow through the taps 30–50 to prevent coagulation of paint within the line. More specifically, the conduit segments 51–92 are dimensioned in accordance with the following formula:

$$\frac{L}{ID^4} = \frac{\Delta P}{.0273 * V * \text{Vol}}$$

where

L = length in feet

ID = inside diameter in inches

P = pressure in psi

V = viscosity of liquid in poise

Vol = flow rate in gallons/minute.

By dimensioning the conduit segments 51–92 in accordance with the above formula, equal rate of flow through any of the taps 30–50 can be obtained without the use of pressure regulators within the piping system. It will be understood, of course, that the actual length and internal diameter of the conduit segments will vary for different piping systems 14 in accordance with the number of liquid taps, the desired flow rate through the system, the viscosity, and the like.

It can be readily seen that either the length of the conduit between stations or the inner diameter of conduit may be found by using the formula. If the distance between the individual paint stations is fixed, the correct inner diameter (ID) can be obtained by inderting the length (oL) of the individual conduit sections. Conversely, if the distance between paint stations may be varied yet only certain conduit diameters are available, the maximum length of each conduit section can be determined by inserting the inner diameter value into the formula.

The pressure loss (PSI) for the individual conduits is a determination of the allowable pressure differential through the conduit section. Since each of the spray stations 30–50 require a predetermined fluid pressure to operate properly, the allowable pressure loss for each conduit section can be readily determined.

The above-identified formula is derived from known engineering formulas for head loss and pressure drop caused by friction of the fluid particles rubbing against one another and a loss of energy available for work. Such pressure drop always accompanies the flow of fluids in a pipe. The general equation for pressure drop is known as Darcy's formula and can be expressed in pressure drop in pounds per square inch as follows:

$$P = .0668 \frac{L \times v}{ID2}$$

However, this formula does not take into account the friction caused by the walls of the pipe and the diameter of the conduit. The instant formula takes these factors into account.

EXAMPLE

By way of example, the following table illustrates one piping system 14 where a flow rate of 0.22 gallons per minute of paint flows through each tap.

The following example provides sample value for selected conduit sections only and should not be viewed as an example of the proper dimensions for every conduit secton in the drawings.

| Conduit No. | Flow Rate (GPM) | In. Dia. (INCH) | Length (FT) | Pressure loss PSI | Velocity (FT/SEC) |
|---|---|---|---|---|---|
| 62 | 15.0 | 1.682 | 479 | 22.06 | 2.17 |
| 64 | 1.97 | .652 | 22.8 | 6.11 | 1.89 |
| 66 | 1.75 | .652 | 12 | 2.86 | 1.68 |
| 68 | 1.53 | .652 | 12 | 2.50 | 1.47 |
| 70 | 1.31 | .652 | 26 | 4.63 | 1.26 |
| 72 | 1.09 | .652 | 15 | 4.23 | 1.44 |
| 74 | .87 | .555 | 19 | 11.88 | 1.92 |
| 80 | .65 | .430 | 33 | 15.42 | 1.43 |
| 82 | 13.03 | 1.682 | 23.91 | .96 | 1.88 |
| 51 | 2.06 | .652 | 26.8 | 7.51 | 1.98 |
| 52 | 1.83 | .652 | 12 | 2.99 | 1.76 |
| 54 | 1.60 | .652 | 12 | 2.61 | 1.54 |
| 56 | 1.37 | .652 | 26 | 4.84 | 1.31 |

Viscosity 90 Centipoise

It will be understood, of course, that in the above table the flow rate in the various conduit segments interconnecting the taps is applicable only if the taps are closed. For example, assuming that the taps 30–40 are all closed, the flow rate through conduit segment 80 is 0.65 gallons per minute. Further, if all the taps 30–40 are closed, the fluid flow rate through the conduit segment 64, would be 1.97 gallons per minute.

Although the piping system 14 illustrated in the drawing shows only one full bank 100 of liquid taps and a portion 102 of a second bank, the conduit segment 93 is preferably connected to and supplies paint to still further banks of paint spray stations.

From the foregoing, it can be seen that the liquid distribution system of the present invention provides a distribution system particularly suited to a paint spray system with multiple paint spray guns which eliminates the previously known need for pressure regulators within the distribution system. Having described my invention, however, many modifications thereto will become apparent to those skilled in the art to which it pertains without deviation from the spirit of the invention as defined by the scope of the appended claims.

I claim:

1. A liquid distribution system comprising: a reservoir of liquid;

a piping system having an inlet and an outlet, said inlet and outlet being open to said reservoir, said piping system further having a supply line in flow communication with said inlet and a return line in flow communication with said outlet;

means for pumping liquid under pressure from said inlet and towards said outlet;

a plurality of connecting lines at spaced intervals along said piping system and each connecting line having an inlet open to said supply line and an outlet open to said return line, each connecting line having a selectively operable liquid tap, each of said liquid taps selectively operable between an open position for diverting liquid from the piping system and a closed position for communicating liquid from said supply line to said return line, said plurality of connecting lines forming the sole fluid connection between said supply line and said return line outside of said reservoir;

said supply line comprising a plurality of conduit segments, each of said plurality of conduit segments extending between a preceding conduit segment and an inlet of one of said taps so that at least a plurality of said conduit segments are connected in series, an internal diameter and length of each conduit segment of said plurality of conduit segments being determined to maintain a predetermined flow rate through each tap of said plurality of taps sufficient to prevent pigment separation of said liquid when said each tap is in said closed position, said internal diameter and length of each of said plurality of conduit segments being dimensioned substantially in accordance with the following formula:

$$\frac{L}{ID^4} = \frac{P}{.0273 \times V \times Vol}$$

(The ID being raised to the fourth power)

where

ID=said inner diameter of said each conduit segment in inches

L=length in feet of said each conduit segment

P=pressure drop in psi through said each conduit segment

V=viscosity of the liquid in poise, and

Vol=required flow rate through said each conduit segment in gallons/minute.

2. The system as defind in claim 1 wherein said liquid comprises paint, said paint being a mixture of a plurality of pigments.

* * * * *